US010087608B2

(12) United States Patent
Dobizl et al.

(10) Patent No.: US 10,087,608 B2
(45) Date of Patent: Oct. 2, 2018

(54) SINK MOUNTED PRODUCT DISPENSING HAND WASHING FAUCET

(71) Applicant: ECOLAB USA INC., Saint Paul, MN (US)

(72) Inventors: Kenneth Thomas Dobizl, Mounds View, MN (US); Sarah Elise Gilbertson, St. Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 61 days.

(21) Appl. No.: 14/091,768

(22) Filed: Nov. 27, 2013

(65) Prior Publication Data

US 2014/0259382 A1 Sep. 18, 2014

Related U.S. Application Data

(63) Continuation-in-part of application No. 13/803,039, filed on Mar. 14, 2013, now abandoned.

(51) Int. Cl.
*E03C 1/046* (2006.01)
*E03C 1/05* (2006.01)
(Continued)

(52) U.S. Cl.
CPC ..... *E03C 1/046* (2013.01); *E03C 1/057* (2013.01); *A47K 5/1217* (2013.01); *A47K 5/14* (2013.01);
(Continued)

(58) Field of Classification Search
CPC ..... E03C 1/0404; E03C 1/046; E03C 1/057; A47K 2210/00; A47K 5/1217; A47K 5/14;
(Continued)

(56) References Cited

U.S. PATENT DOCUMENTS 4,398,310 A 8/1983 Leinhard
7,228,874 B2 * 6/2007 Bolderheij ..... E03C 1/04 137/801
(Continued)

FOREIGN PATENT DOCUMENTS

WO WO 2012/156737 A1 11/2012

OTHER PUBLICATIONS

International Searching Authority, "International Search Report and Opinion," Issued in connection to International Application No. PCT/US2014/061920, dated Feb. 6, 2015, 13 pages, dated Feb. 6, 2015.

*Primary Examiner* — Craig Schneider
*Assistant Examiner* — Frederick D Soski
(74) *Attorney, Agent, or Firm* — McKee, Voorhees & Sease, PLC

(57) ABSTRACT

An apparatus, method and system for providing and dispensing various hand care alternatives from a common point of dispension, such as a faucet, for standardizing the hand care, washing, sanitizing, and drying process is disclosed. Included is a liquid flow path having an inlet in fluid communication with a liquid source and an outlet in fluid communication with a user reception point. A secondary flow path has an inlet in communication with one or more hand care alternatives and an outlet in communication with the user reception point. A first pump operatively connected to the hand care alternative and a second pump, independent from the first, pumps air. The air and hand care alternative may be mixed and foamed. In use, the air pump can provide clearing, drying and mixing functions independent from the first pump.

11 Claims, 12 Drawing Sheets

(51) Int. Cl.
*A47K 5/12* (2006.01)
*A47K 5/14* (2006.01)

(52) U.S. Cl.
CPC .. *A47K 2005/1218* (2013.01); *A47K 2210/00* (2013.01); *Y10T 137/0318* (2015.04); *Y10T 137/9464* (2015.04)

(58) Field of Classification Search
CPC ..... A47K 2005/1218; Y10T 137/0318; Y10T 137/9464
See application file for complete search history.

(56) References Cited

U.S. PATENT DOCUMENTS

| | | | | |
|---|---|---|---|---|
| 7,364,053 | B2 * | 4/2008 | Ophardt | 222/190 |
| 7,455,197 | B2 * | 11/2008 | Ophardt | A47K 5/16 222/132 |
| 8,528,579 | B2 * | 9/2013 | Jonte et al. | 137/1 |
| 2004/0069817 | A1 * | 4/2004 | Jacques | A01M 7/0046 222/529 |
| 2005/0133100 | A1 * | 6/2005 | Bolderheij et al. | 137/801 |
| 2006/0101575 | A1 * | 5/2006 | Louis | 4/676 |
| 2007/0152082 | A1 * | 7/2007 | Hyslop | 239/428 |
| 2007/0201923 | A1 | 8/2007 | Asada | |
| 2009/0000024 | A1 * | 1/2009 | Louis et al. | 4/676 |
| 2012/0291195 | A1 | 11/2012 | Courtney et al. | |
| 2013/0032614 | A1 | 2/2013 | Babikian | |
| 2013/0291947 | A1 | 11/2013 | Chandler | |

* cited by examiner

SINK MOUNTED PRODUCT DISPENSING HAND WASHING FAUCET

CROSS-REFERENCE TO RELATED APPLICATIONS

This Application is a Continuation-in-part application of U.S. Ser. No. 13/803,039 filed Mar. 14, 2013, which is incorporated herein by reference in its entirety.

FIELD OF THE INVENTION

This invention relates generally to an apparatus, method and system for standardizing hand care, and more particularly to an apparatus, method and system for dispensing hand care alternatives from a common point of dispension, such as a faucet, for standardizing the hand care, washing, and sanitizing process.

BACKGROUND OF THE INVENTION

Devices such as faucets, spigots and other liquid dispensing components used for hand washing provide a stream of water, often times alterable to a comfortable temperature, for prior wetting and subsequent rinsing of one's hands during a hand washing operation. Other systems separate from the faucet, often provide the soap needed to complete the hand washing operation. Such soaping systems typically involve a separate component which may be mounted to the sink or a standalone soaping bottle. Both typically involve a closed product bottle. When activated, the soaping system typically uses a bottle mounted pump to displace the product which may be a liquid or foam depending on the style of the pump. The known foaming dispensers use a liquid chamber and air pumps and allow for a singular volume of both product and air based on the sizing of the pump. This fixed volume of air and timing of dispense provided by the bottle pump limits the function of the dispensing operation and its output.

Additionally, such foaming dispensers typically have the product bottle and pump mounted directly below the counter and faucet or at least very near to the faucet. For example, the bottle in such systems is usually mounted to the dispensing faucet with an integrated pump to generate pressure or foam. In such systems a tube is routed through the faucet head, with the goal to keep the tube as short as possible. This is most likely done to prevent or limit the amount of soap that resides after each dispenser cycle. If the product is foamed, the foam may break down in the bottle thus turning back into liquid for the next dispense cycle. It is therefore desirable to provide a system which allows the product to be cleared from the supply tube or flow path. It is also desirable to provide a system in which the pump and bottle may be located further away from the faucet.

Product is typically delivered through a single point of delivery which is separate from the water point of delivery of the water. In the process, water is wasted, soap is wasted, and both dispensing components (i.e., the faucet and soap dispenser) are handled extensively at different points in the hand washing operation by multiple users, which often contributes to the unwanted and unintended spread of germs, even in instances where washed hands make contact with or retouch/handle features associated with the faucet or soap dispenser.

These issues are compounded throughout a period of use as each new user touches many of the same surfaces, handles, levers and touch points as the previous users. Even after the washing process is complete, subsequent handling of paper, cloth and air dispensers used for drying ones hands continue the spread and propagation of germs. This is witnessed, for example, when washed hands touch handles or levers of the faucet where germs may reside and subsequently handle the dispenser providing a means for drying the hands. The distance in separation between these systems can also drive inefficiencies, compound the spread of germs, and create dangerous environments, such as where hands drip on the floor while moving from the faucet to a towel dispenser or air dryer. Depending upon the amount of use of the faucet, the soap dispenser, and even the dispenser for drying ones hands, it may be virtually impossible to handle these devices without coming into contact with germs or other unwanted substances that reside at locations where one must contact the dispensers to initiate the process.

The present invention addresses these problems and provides for an apparatus, method and system for standardizing a hand washing and sanitizing process.

In addition, the present invention addresses these problems and provides for an apparatus, method and system for touch-free dispensing of a plurality of hand care alternatives from a common point of dispension for standardizing the hand washing and sanitizing process.

SUMMARY OF THE INVENTION

According to an aspect of the invention, a faucet adapted to provide a plurality of hand care alternatives. The faucet includes a liquid flow path having an inlet in fluid communication with a liquid source and an outlet in fluid communication with a user reception point. The faucet also includes a secondary flow path having an inlet in communication with one or more hand care alternatives and an outlet in communication with the user reception point. The secondary flow path also includes an outlet in communication with the user reception point with a first pump in communication with the one or more hand care alternatives storage compartments and a second pump independent from the first pump, the second pump in communication with an air source. Preferably, the first pump is a positive displacement pump which is used to deliver a predetermined amount of soap into the secondary flow path.

Preferably, the soap is delivered into a mixing chamber which is also included in the secondary flow path. The mixing chamber is in downstream communication with the first pump and the second pump and may be located substantially away from the pumps. Preferably, the mixing chamber is located near the outlet to minimize the amount of foam or product which may be left in the flow path after dispensing. If foam is desired, a foaming chamber including a foaming medium may be included. Typical foaming medium can include a screen, sponge or mesh. The secondary pump uses air to force the liquid soap product through the foaming medium to create a large enough disturbance in the product to create a foam. The foaming chamber can be located inside the mixing chamber or downstream from the mixing chamber. The pressure created by the secondary pump uses air to force the product, whether in foam or liquid form through the secondary flow path and into the outlet port of the dispenser.

The first pump is independent from the second pump. This independence allows for the second pump to be activated at different times and for different durations. This can create different flow rates and tactile profiles depending on user preference and product selection. These changes to flow rates and durations can typically be made by the software controlling the dispensing cycle, a manual valve to adjust air, a mixing chamber component or by adapting different sizes or styles of second pumps.

The use of the second pump independent from the first pump also allows for the product to be cleared from the system. This minimizes product contact with components that would otherwise be in constant contact with liquid and/or product solution. It also minimizes the risk of product remaining and creating clogs in the flow path. By clearing the product from the system, clogging chances are minimized to enhance the user experience and functionality of the device. Additionally, by clearing the product from the system, wear on components can be minimized to increase the lifespan of the system and/or reduce system component costs. Such clearing also allows new foam to be generated with every dispense cycle.

A user-perceivable output provides notification of the hand care operation being provided at the user reception point. In a preferred form, the faucet also includes a supplementary source that controls a tactile attribute of the hand care operation provided at the user reception point that may include volumetric expansion of the hand care alternative and/or liquid, dispensing pressure reductions for the hand care alternative and/or liquid, and controlling dispension temperatures of the hand care alternative and/or liquid.

According to another aspect, the invention is a system adapted for dispensing a plurality of hand care alternatives from a common point of dispension for standardizing the hand washing process. The system includes a liquid flow path and a product flow path. The liquid flow path includes an inlet in fluid communication with a liquid source and an outlet in fluid communication with a user reception point. The product flow path includes an inlet in communication with one or more hand care products and an outlet in communication with the user reception point. A user-perceivable output provides notification of the hand care operation being provided at the user reception point. In a preferred form, the system also includes a mixing flow path having an inlet in communication with the liquid flow path and an outlet in communication with the product flow path for controlling a tactile attribute of the hand care operation at the user reception point.

According to yet another aspect, the invention is a method for dispensing a plurality of hand care alternatives from a common point of dispension for standardizing the hand washing process. The method includes providing a liquid flow path having an inlet in fluid communication with the liquid source and an outlet in fluid communication with the user reception point. A hand care product is communicated through a product flow path having an inlet in communication with the hand care product source and an outlet in communication with the user reception point. The user is notified of the hand care operation being provided at the user reception point by a user-perceivable output. In a preferred form, the method also includes triggering the hand care operation by detection of occupation of the user reception point by a user's hands and sequencing the hand care operation based on a standard operation or upon an input at a user interface resulting from a user selection. In addition to providing the hand care products of a soap, a lotion, a sanitizer and/or a freshener, the method may also include communicating a forced stream of air to the user reception point for drying the user's hands as part of a drying sequence.

BRIEF DESCRIPTION OF THE DRAWINGS

While the specification concludes with claims particularly pointing and distinctly claiming the invention, it is believed that the present invention will be better understood from the following description taken in conjunction with accompanying drawings, in which:

DETAILED DESCRIPTION OF THE PREFERRED EMBODIMENTS

Figure 1:
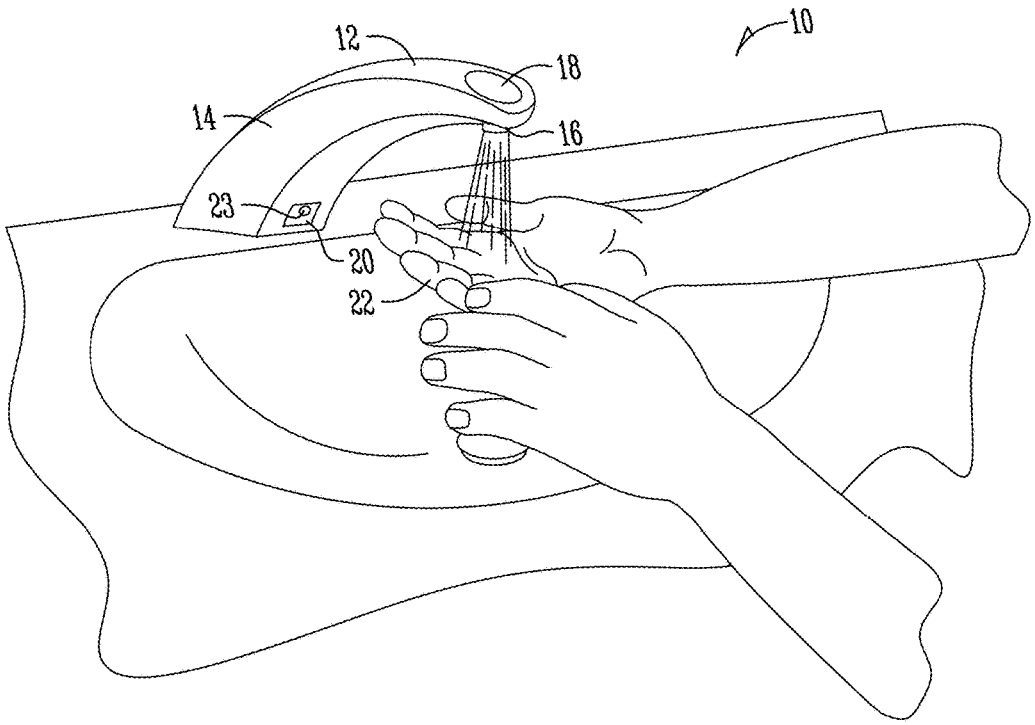
FIG. 1 is a perspective view of a dispensing system according to an exemplary embodiment of the present invention.

FIGS. 1-6 illustrate exemplary aspects and concepts for standardizing hand care by dispensing hand care alternatives from a common point of dispension, such as a faucet. By way of example, FIG. 1 illustrates a perspective view of a dispensing system 10 configured to perform one or more hand care operations for fulfilling one or more of the above identified objectives of the present invention. The dispensing system 10 includes a faucet 12. The faucet may be in the form of a spigot, kitchen or bathroom faucet, laboratory faucet, or any like liquid dispensing component. The faucet 12 includes a body 14 having a plurality of exterior surfaces interconnected and forming a base by which it may be mounted proximate a basin, such as a sink. On the body 14 of the faucet 12 is a dispension point 16. The dispension point 16 is configured to direct liquid dispensions from the body 14 to a user reception point 22. The user reception point 22 is generally between the dispension point 16 on the body 14 of the faucet and the basin or sink used to collect dispensions from the faucet 12.

Figure 7:
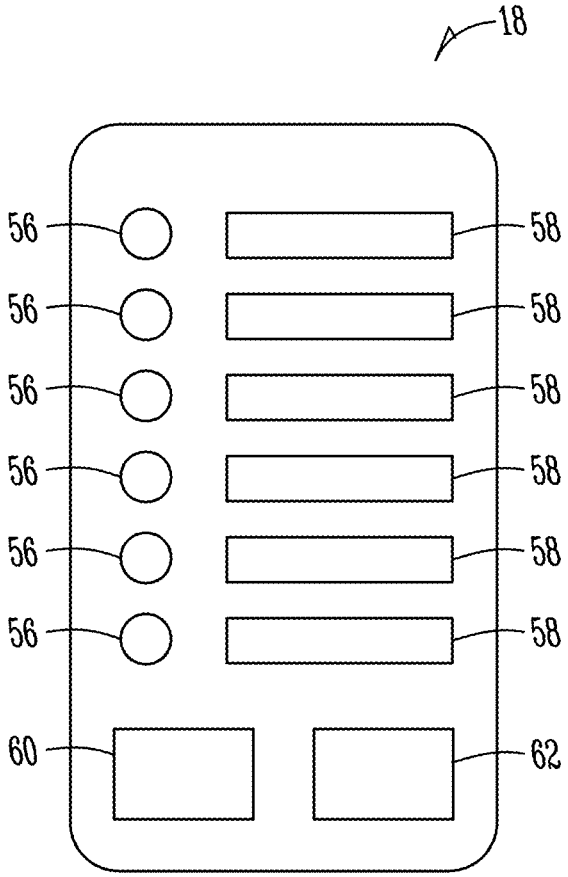
FIG. 7 is an illustration of an exemplary user interface.

The faucet 12 also includes a sensor 20 positioned on a surface of the body 14 for monitoring activity at the user reception point 22. The invention also contemplates that the sensor 20 may be positioned at other locations for monitoring activity at the user reception point 22 such as in a sidewall of the basin or sink to which the faucet 12 is mounted. A user interface 18 is also provided, and is located preferably on the body 14 of the faucet 12 for indicating operation or step sequences being performed by the faucet 12. The user interface 18 may be configured to receive input from the user and preferably includes an output for providing information to the user during operation of the dispensing system 10, as illustrated in FIG. 7. The present invention contemplates that the user interface 18 may be positioned at other visible locations within the view of a user while at the dispensing system 10. For example, the user interface 18 may be located adjacent the faucet 12 such as on a countertop or on a surface of the basin or sink to which the faucet 12 is mounted. A water override button 23 is also preferably included above the sensor 20 on the faucet 12. The water override button 23 allows the user to bypass the product dispense cycle to allow for a temporary use of the dispenser as a water dispensing faucet. This allows for additional rinsing when desired. The water override button 23 is preferably operably connected to the same electrical board as the sensor 20, but it is its own button. The water override button 23 may be operated independent of the sensor 23 as a manual process by the user. When the system is not running a hand wash cycle, the button 23 can be pressed and held to start the flow of water. In the manual mode, water shuts off when the user releases the button 23. In another method, the user can press and release the button 23 and the flow of water will continue until the user presses the button 23 again to shut it off. Alternatively, a max runt time or run volume may be predetermined and programmed into the controller 32 in case the user forgets to push the button 23 to shut off the water.

Figure 2:
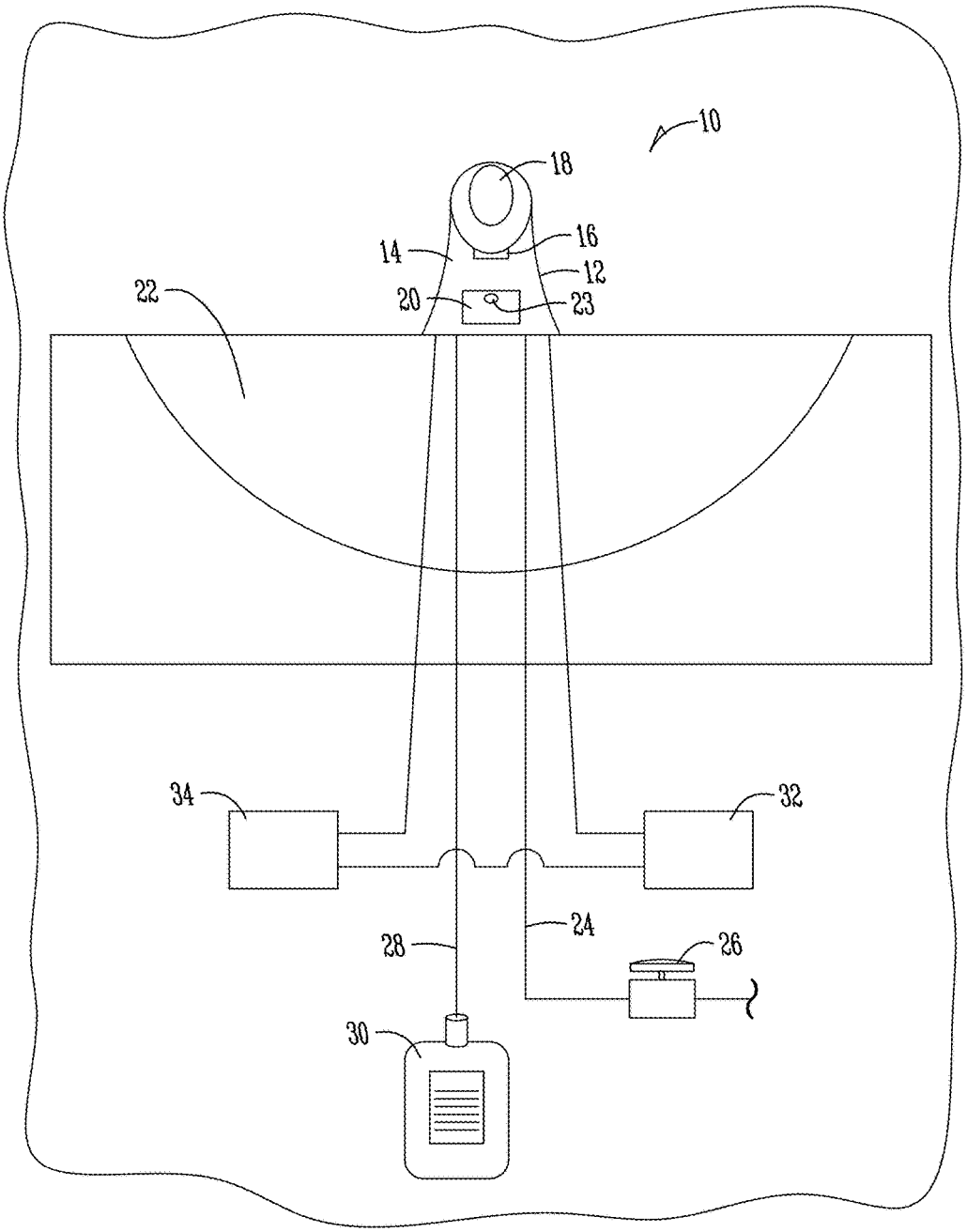
FIG. 2 is a diagram for an exemplary embodiment of the dispensing system shown in FIG. 1.

FIG. 2 illustrates a front elevation perspective of the dispensing system 10 shown in FIG. 1. One or more of the exemplary inputs into the dispensing system 10 are illustrated in FIG. 2. For example, the dispensing system 10 includes a liquid flow path 24 connected in communication with the faucet 12 and a liquid source 26 for use in the dispensing system 10 and for dispensing from faucet 14 at dispension point 16. Also included in the system 10 is a product flow path 28 connected in communication with the faucet 14 and a product source 30. As will become apparent from further discussion below, the dispensing system 10 may include one or more product flow paths connected in communication with separate product sources. The product flow path 28 provides product at the faucet 12 for dispensing at one or more dispension points, such as dispension point 16. Dispensing system 10 also preferably includes a controller 32 for controlling and operating one or more dispensing sequences associated with the dispensing system 10. One or more power inputs 34, such as from an electrochemical source or wall outlet, may be used to power operation of the electrical components used in the dispensing system 10. In a preferred form, the dispensing system 10 includes an independent power source such as a battery supply for powering operation of the electrical operating components.

FIGS. 4-6 and 8-9 illustrate exemplary plumbing diagrams for showing possible configurations for various flow paths used in the dispensing system 10. The dispensing system 10 includes a liquid flow path 24 connected in fluid communication with a liquid source 26 such as a municipal, principality, or well-provided liquid source. The present invention also contemplates that the liquid source 26 may be a source that requires replenishment or one that only offers a metered amount of liquid dispension, followed by subsequent replenishment of a storage point from which the liquid is drawn. In a preferred form, the liquid flow path 24 is connected in fluid communication with a water source providing a continuous and constant flow and pressure of liquid. The liquid flow path 24 may also include one or more valves, such as valve 38 for controlling the flow of liquid through the flow path 24. The valve 38 may be a check valve to prevent backflow of liquid within the system. In one aspect of the invention, the liquid flow path 24 includes an inlet connected in fluid communication with the liquid source 26 and an outlet connected in fluid communication with the dispension point 16 of the faucet 12.

The dispensing system 10 also includes a product flow path 28. Liquid or foam product is supplied to the product flow path 28 from a product source 30. The liquid or foam product may include any number of hand care alternatives, such as those used in the washing, sanitizing, and/or care of a user's hands. The product source 30 may include liquid or foam soaps, sanitizers, fresheners, conditioners (e.g., lotion), prewash, pre-rinse, rinse aids, drying aids, or any like solution that may be used in the care and/or washing of one's hands. These solutions are preferably in liquid or foam form, but may be in a dry form, which is subsequently dissolved into a liquid form for dispensing at the dispension point 16. In one configuration of the dispensing system 10, a first pump 36 is connected in operable communication with the product source 30 for pumping liquid or foam product through the product flow path 28 to the dispension point 16. The present invention contemplates that the first pump 36 may be a peristaltic pump (i.e., P-pump), diaphragm pump, piston pump, gear pump, centrifugal pump, etc. The product flow path 28 may include one or more valves 40, such as a check valve, to prevent backflow within the dispensing system 10.

The liquid flow path 24, product flow path 28, and/or mixer 52 may be configured to provide liquid and product dispensions from the dispension point 16 as separate streams, combined streams, sequential streams, or one stream surrounding another stream. The streams may be combined within the system 10, at the point of dispension 16, or in midair between the dispension point 16 and the user reception point 22.

Figure 8:
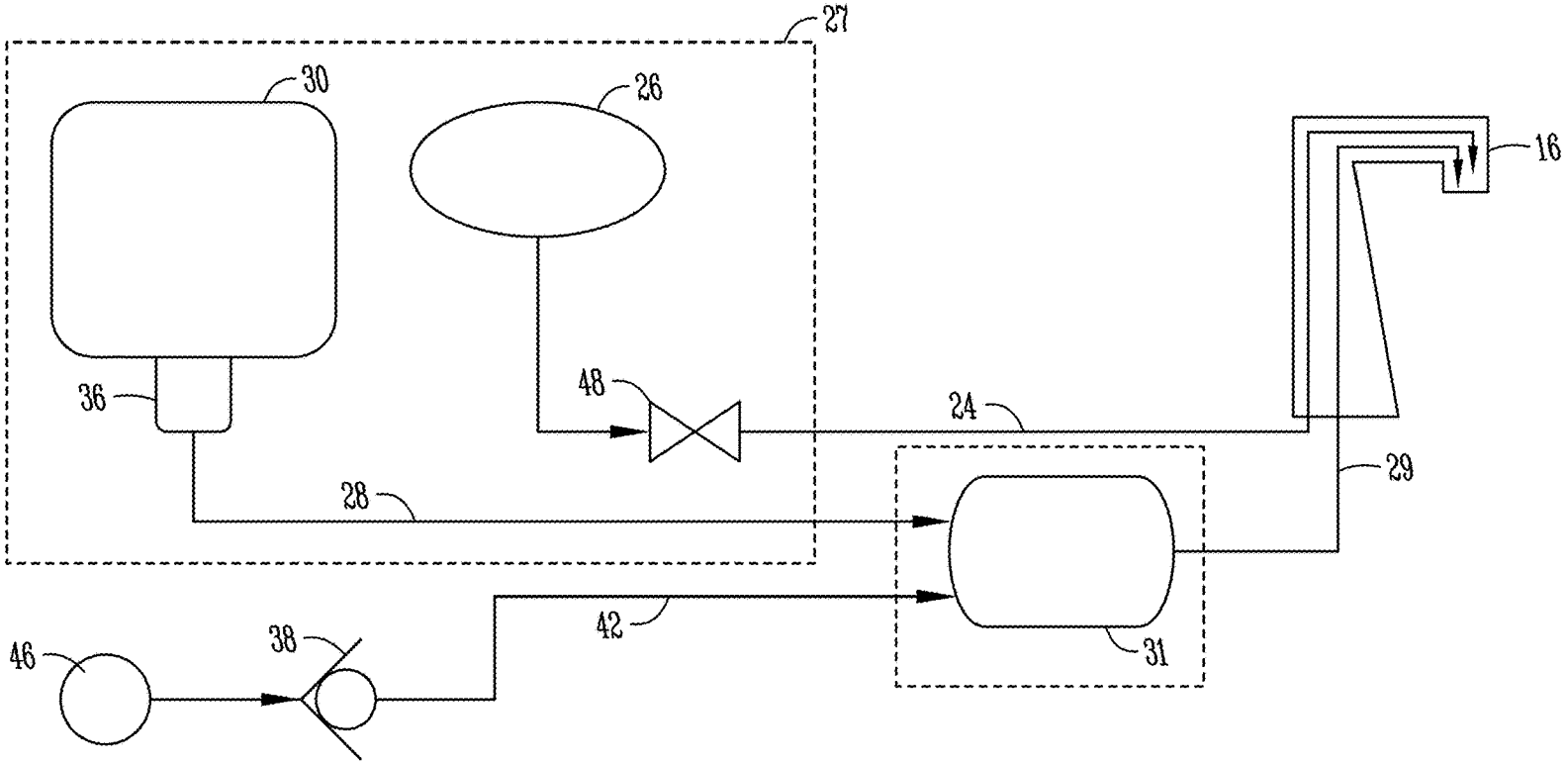
FIG. 8 is a schematic of another plumbing diagram for use with the present invention.
Figure 9:
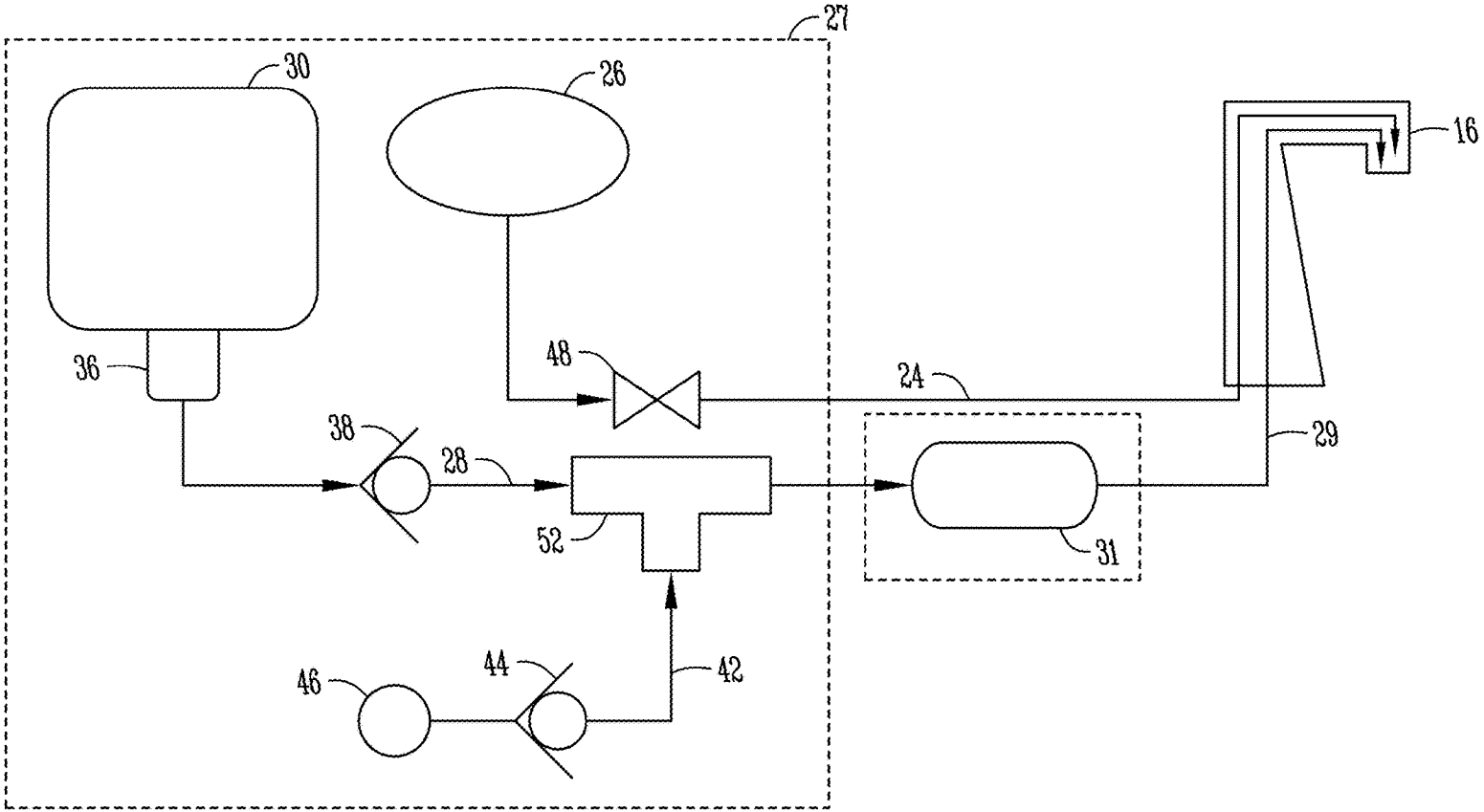
FIG. 9 is a schematic of another plumbing diagram for use with the present invention.
Figure 10:
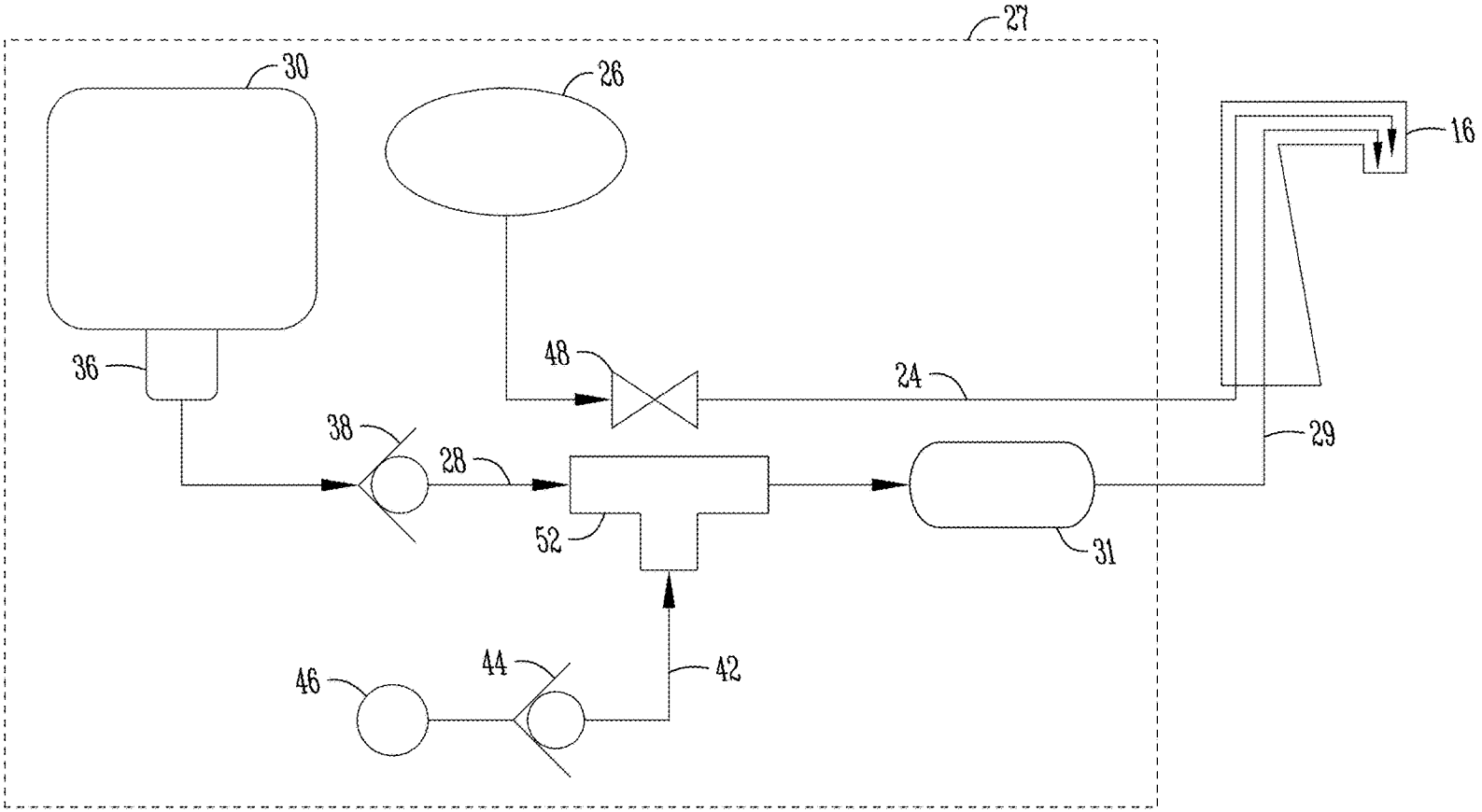
FIG. 10 is a schematic of another plumbing diagram for use with the present invention showing the foamer chamber and mixing valve as part of the dispenser module.

As shown in FIGS. 8 and 9, an air flow path 42 is also connected and in communication at the dispension point 16. The air flow path 42 may be connected in communication with a pump or fan 46 for directing forced air at a desired temperature through the flow path 42 to a dispension point at the faucet. Preferably, this second pump 46 is independent from the first pump 36, though it may be the same type of pump or any of the pumps. A valve 44, such as a check valve, may also be used to prevent backflow through the air flow path 42 from the dispension point. Additional flow paths may be included to move additional products to the dispension point 16, to allow the system to provide multiple products at the dispension point 16.

A mixer 52, such as a mixing valve or mixing flow path, may be used to ratio the parts of water relative to the parts of liquid or foam product dispensed at the dispension point 16. The mixer 52 may also be used to control tactile attributes of the resulting flow of liquid dispensed at the dispension point 16. For example, the mixer 52 may be used to volumetrically expand product received from the product flow path 28, which may be combined with liquid from the liquid flow path 24 before or after expansion. The mixer 52 may also be used to control the pressure at which dispension occurs at the dispension point 16. This may include controlling the pressure of one or more of the products being dispensed at the dispension point 16. For example, the mixer 52 may be used to control the pressure of product received from the product flow path 28 and liquid received from liquid flow path 24. The pressure of these respective flows may be dependently controlled based upon the product being received. For example, the pressure of a soap product received through the product flow path 28 may be adjusted to a different pressure at the mixer 52 than other products, such as a sanitizer or hand conditioner received through a product flow path 28 at the dispension point 16.

In operation and upon detection of a user's hands at the user reception point 22, the valve 38, such as a solenoid valve operated by controller 32, opens to allow liquid to pass through the liquid flow path 24 from the liquid source 26 and towards the mixer 52. The liquid may be dispensed as a prewash sequence and at a pressure lower than the pressure of the source 26 to optimize the hand wetting (i.e., prewash) process. The cycle time of this sequence (i.e., the time the valve 38 remains open) may also be optimized to provide an optimal prewash, hand wetting sequence.

As is discussed below and shown by way of example in FIG. 7, the user interface 18 may include a display indicating to the user the sequence in the hand washing operation that is currently being run by the dispensing system 10. This may include, for example, an LED display or indicators that provide one or more user-perceivable notifications 56 to the user informing him or her of the dispensing sequence(s) 58. The feedback to the user, or the user-perceivable notification 56, may be provided audibly, visually, or through tactile interaction with the user. The user interface 18 may also include sequence information 60 (e.g., dispensing temperature, pressure, product description, product brand, product attributes, etc.) and sequence runtime information 62 (e.g., elapsed sequence time, total sequence time, time to next sequence, etc.). Upon completion of the prewash sequence, the pump 36 is cycled to move a charge of product from the product source 30 to the mixer 52. For example, in a wash sequence soap is pumped from the product source 30 through the product flow path 28 to the mixer 52. The soap may be dispensed alone or in combination with liquid from the liquid flow path 24 at the dispension point 16. In a preferred aspect of the invention, liquid or foam soap is volumetrically expanded and mixed with liquid from the liquid flow path 24, or mixed with liquid then expanded, by mixer 52 and dispensed at the dispension point 16.

The flow stream of liquid and liquid or foam soap mixed together and dispensed at the dispension point 16 has a sufficient lather and tactile feel, which provides feedback to the user of the type of dispensing cycle or sequence that the dispensing system 10 is currently running. The user is likely able to also visually perceive by viewing the user interface 18 or viewing the liquid dispension from the dispension point 16 that the dispension includes soap or some other type of hand care product. This will also be apparent to the user tactilely as the user is able to feel the difference between the prewash dispension and the wash dispension as a result of the soap lather in the dispension in the wash sequence.

The wash sequence cycles for an optimal amount of time, which allows the user to receive an adequate quantity of soap for lathering (e.g., a few seconds). Both the pump 36 and valve 38 may be cycled to off/closed to provide a delay or a pause in the dispensing sequence to allow the user to work the soap into a lather. After an optimal period of time lapses, the dispensing system 10 may be activated to initiate a rinse sequence, where valve 38 opens to allow liquid to flow from the source 26 to the dispension point 16 for rinsing the soap composition from the user's hands. The rinse cycle may be operated at the pressure of the source 26 or at a lower pressure adjusted by the mixer 52. Alternatively, a pump may be connected in communication with the liquid flow path 24 for increasing the pressure above that pressure of the source 26 for providing a high pressured rinse at the dispension point 16.

The present invention also contemplates that the liquid flow path 24 may be connected in fluid communication from the thermostatic mixing valve for controlling the temperature used in any one of the dispensing sequences of the liquid from the source 26. After the rinse sequences its cycle for an optimal period of time, the dispensing system closes the valve 38 to stop dispension of the liquid at the dispension point 16. The dispensing system 10 also includes an air flow path 42 connected in communication with a source for providing a heated stream of air at the point of dispension 16. The second pump 46 may include a heating element for adjusting the air temperature of the air communicated through the air flow path 42 to the dispension point 16. The air flow path 42 may also be connected in communication with the liquid flow path 24 or product flow path 28 to aerate either or both flows separately or after being combined and to aid in moving the liquid and/or product through the system 10.

The user interface 18 indicates to the user the next step in the dispensing sequence, such as, for example, a drying step following a rinse sequence. The warm air for drying may be communicated through the mixer 52, the dispension point 16, or another dispension point on the body 14 of the faucet 12. The fan 46 is cycled for an optimal period of time to allow the user to dry his or her hands using air dispensed at the dispension point 16 or another dispension point on the body 14 of the faucet 12. The sequence time 62, sequence description 58, and sequence information 60 for each sequence may be shown on the user interface 18. Upon completion of the drying sequence, the fan 46 is turned off and the hand washing operation is complete.

The present invention also contemplates that the air flow path 42 may be connected in fluid communication with the mixer 52 to purge liquid from the mixer 52 just prior to the beginning of a drying sequence. As is addressed below, any one of the dispensing sequences may be repeated during the hand washing operation, such as where the user keeps his or her hands at the user reception point 22 during a rinse sequence or a drying sequence to provide further rinsing or further drying longer than the initial rinse or drying sequence time allotment.

The present invention also contemplates that multiple products may be dispensed through a product flow path 28 to the point of dispension 16. These products may be mixed using the mixer 52 with liquid from the liquid flow path 24, as necessary. For example, the product flow path 28 may be connected in fluid communication with a product source 30 containing a hand sanitizer or a hand conditioner. The present invention also contemplates that the mixer 52 and dispension point 16 may be configured to dispense any one of these products in a desired fashion. For example, a hand sanitizer may be dispensed onto the hands of the user as a mist or spritz, as opposed to being dispensed in a single, continuous flow stream. The hand conditioner may also be mixed with liquid from the liquid flow path 24 and dispensed as a spritz or a mist onto the hands of the user as one example of dispensing product onto the hands of the user for performing a sequence or sequences of a hand washing operation.

A hand sanitizing or hand conditioning sequence may be part of the hand washing operation or conducted separately, for example, upon completion of a hand washing operation, and upon detection of the user's hands at the user reception point 22. The dispensing system 10 may be configured to spritz or mist a hand conditioner at the dispension point 16 after, for example, the drying sequence is completed. This step, like the others, may be repeated if the sensing system 10 detects the user's hands at the user reception point 22 upon completion of the first cycling of the step. The dispensing system 10 may also be configured to dispense only certain products associated with a hand washing operation. For example, the dispensing system 10 may be configured to dispense a hand sanitizer upon detection of a user's hands at the user reception point 22. The dispensing sequence may be included or be separate from the overall hand washing operation. Further details are provided below regarding operation of the system for detecting a user's preference for engaging or disengaging (i.e., turning off and on) certain desired or undesired dispensing sequences of a hand washing operation.

The present invention also contemplates that the product flow path 28 may be connected in fluid communication with a pre-rinse product, such as a chemistry configured specifically for tough stains, grit, dirt, or other substances that require more than the normal soap sequence to remove from the user's hands. In this instance, the user may receive a charge of a prewash solution at the dispension point 16. The system 10 may be configured to pause to allow the user to work the prewash solution prior to engaging the wash or rinse sequence of the operation. The user interface 18 provides user perceivable notifications to the user of the dispensing sequence currently being run by the dispensing system 10. In this instance, the user, whether by visual, audible, or tactile feedback, receives notification that the dispensing system 10 is dispensing a prewash solution. Once the user's hands are detected at the user reception point 22, the dispensing system 10 dispenses the prewash solution at the dispension point 16 and resumes the hand washing operation.

Figure 5:
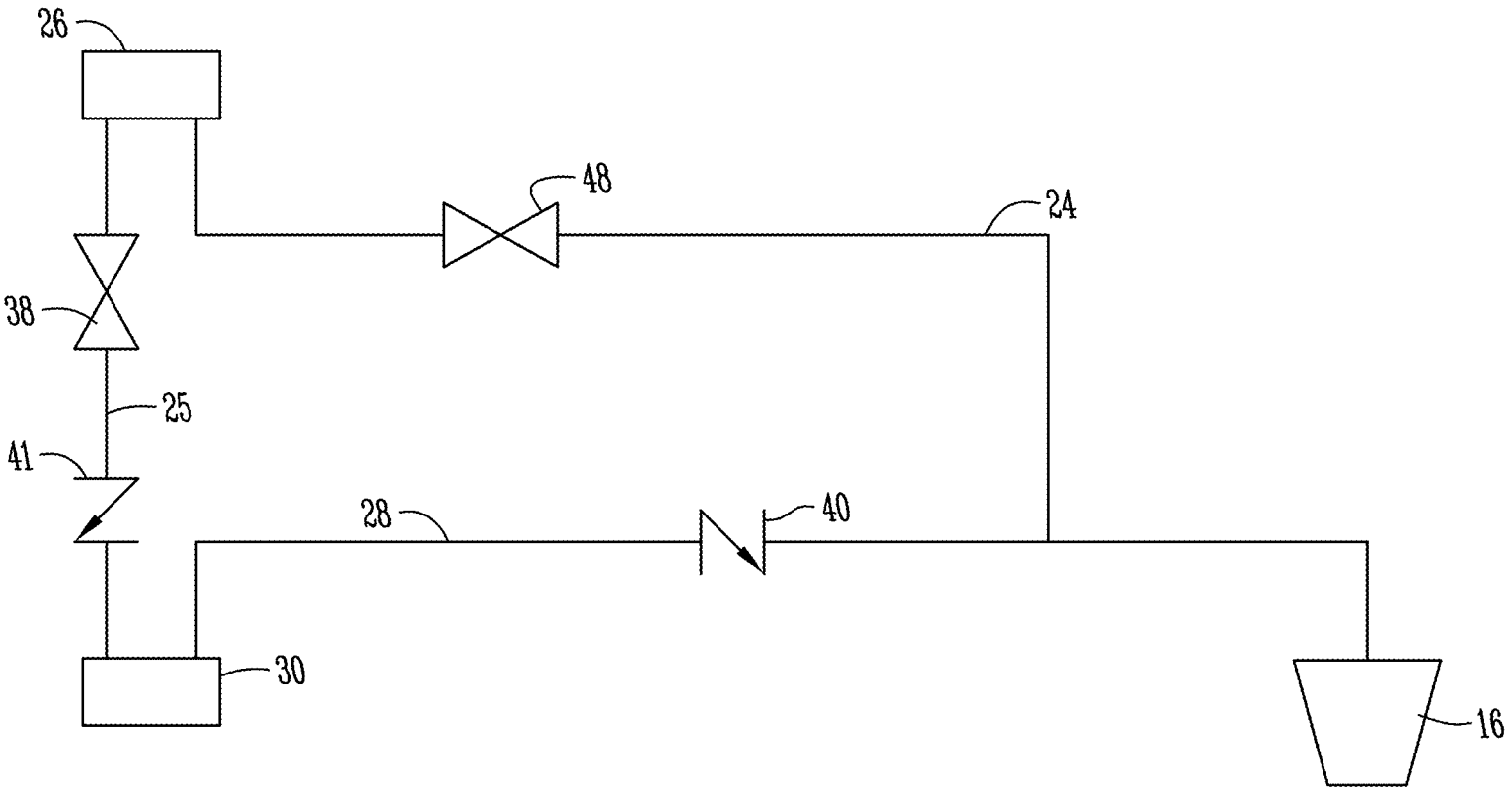
FIG. 5 is another exemplary plumbing diagram an embodiment of the present invention.

FIG. 5 is another exemplary plumbing diagram for an embodiment of the dispensing system shown in FIG. 1. The dispensing system 10 according to the embodiment illustrated in FIG. 5 includes a liquid source 26 connected in fluid communication with the dispension point 16. A valve 48, such as a solenoid valve operated by controller 32, operates the liquid flow path 24 between open and closed positions. A product flow path 28 is connected in fluid communication with a product source 30 and the dispension point 16. Preferably, one or more valves 40, such as a check valve, are included in-line to the product flow path 28.

A secondary liquid flow path 25 is connected in fluid communication with the liquid source 26 and product source 30. One or more valves may be included in-line to the secondary liquid flow path 25. For example, a solenoid valve 38 and a check valve 41 may be included to control the flow from the liquid source 26 to the product source 30 and to prevent backflow. Upon activation of the valve 38, liquid from the source 26 is used to move product from the product source 30 through the product flow path 28 and towards the dispension point 16. In one aspect of the invention, product is moved from the product source 30 to the point of dispension 16 by venturi affect or from pressure applied on the product source 30 or product in the product source 30 by liquid from the secondary liquid flow path 25. In this embodiment, product is communicated from the product source 30 to the dispension point 16 without using a pump. Additionally, the venturi affect and the pressure applied by liquid passing through the secondary liquid flow path 25 may be used to control the ratio of liquid-to-product. Furthermore, the secondary flow path 25 may incorporate gravity to deliver the product.

Like other embodiments of the dispensing system 10, the system 10 shown in FIG. 5 may include additional flow paths, such as an air flow path, or additional product flow paths. The air flow path may be used to provide a hand drying sequence, to mix with the product, or to create a desired (e.g., tactile) attribute in the dispension received at the user reception point 22. This may include, amongst other things, volumetrically expanding, heating, cooling, and regulating pressure of the liquid and/or product before or during dispension. A mixing valve may also be included at junctions between paths to regulate downstream ratios between liquid (e.g., diluent) and product. In operation, valve 48 opens to allow liquid from the liquid source 26 to be communicated to the dispension point 16 during a prewash sequence. During a product application sequence, valve 38 opens and liquid is communicated from the liquid source 26 to the product source 30 to move product alone or as a mixture with liquid to the dispension point 16. The valve 48 may be controlled to add liquid to the flow of product in the product flow path 28 during dispension. A pressure regulator may be used in one or more of the flow paths to control the pressure of liquid and/or product during one or more of the sequences of the hand washing or hand care operation.

The dispensing system may also include a mixing valve or mixing flow path (not shown) for controlling the ratio of liquid to product being dispensed at the dispension point 16. A mixing valve or mixing flow path (not shown) may also be included to control the temperature of liquid from the liquid source 26 during various sequences of the hand washing process.

During a rinse sequence, the valve 38 is closed and valve 48 is opened to allow liquid from the liquid source 26 to pass through the liquid flow path 24, which is dispensed, from the dispension point 16 to the user reception point 22 for the user to rinse his or her hands. Subsequent dispensing sequences may also be provided similar to those described above. For example, a hand freshener, a hand sanitizer, or a hand conditioner may be communicated from a source through a product line to a point of dispension. The dispensing system shown in FIG. 5 may also include an air flow path (not shown) to provide a stream of temperature controlled air at the point of dispension 16 for drying a user's hands or imparting a tactile attribute to the liquid being dispensed. The air flow path may also be mixed with the product to create foam and/or to aid in moving the product.

These and/or other hand washing sequences may be provided as part of the hand washing or hand care operation. A nozzle may also be configured at the point of dispension 16 for controlling the manner in which liquid and/or product is dispensed to the user reception point 22. Some product dispensing sequences may entail dispensing product as a mist or a spritz, whereas other dispensing sequences entail dispensing product as a stream. A dispensing system 10 may also include multiple dispension points. For example, the dispensing system 10 may include a dispension point for dispensing one sequence of the hand washing operation and another dispensing point for dispensing another sequence of the hand operation. By way of an example, the dispensing system may include a dispension point for liquids and another separate dispension point for an air flow stream providing a hand drying sequence. In another example, a separate dispension point may be included for dispensing a sanitizer or hand conditioner from a point separate from dispension point 16. These different points of dispension may be configured into the body 14 of the faucet 12 so as to be directed toward the user reception point 22.

Figure 6:
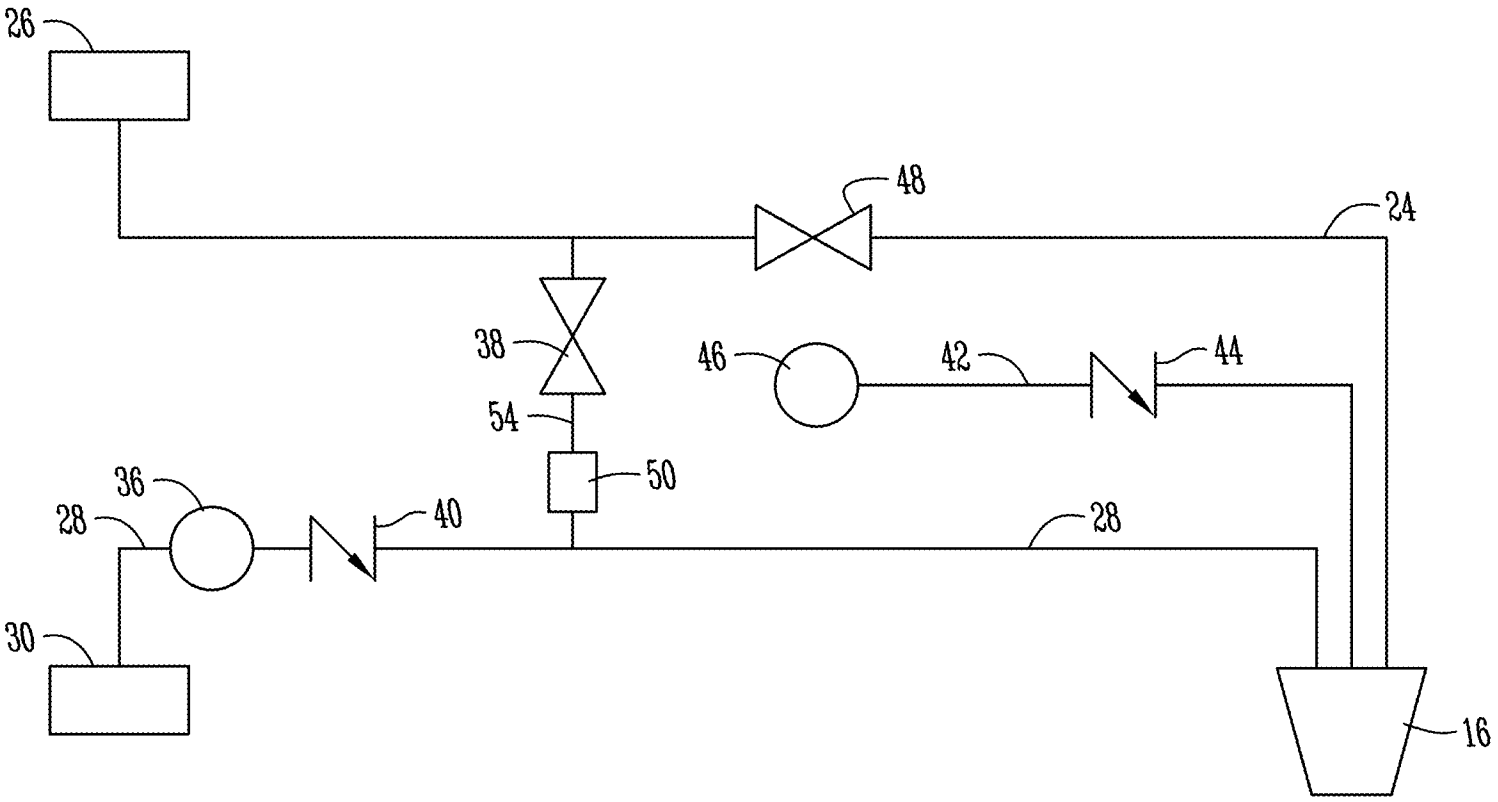
FIG. 6 is another exemplary plumbing diagram for an embodiment of the present invention.

FIG. 6 illustrates another exemplary dispensing system of the present invention. The dispensing system illustrated in FIG. 6 includes a liquid source 26 connected in fluid communication with a dispension point 16. A valve 48, such as a solenoid valve, is included in line with the liquid flow path 24 between these two points. A product flow path 28 is also connected in fluid communication with dispension point 16 and product source 30. A pump 36, such as those previously described, is connected in operable communication with the product source 30 for pumping product through the product flow path 28 to the dispension point 16. In addition, air may be used instead of the pump to move the product through the product flow path. A valve, such a check valve 40, is included in-line to prevent backflow and contamination of the product source 30.

A mixing flow path 54 is connected in fluid communication with the liquid flow path 24 and the product flow path 28. The mixing flow path 54 may include a valve, such as a solenoid valve 38, and a regulator 50 for controlling the pressure of liquid from the liquid source 26. An air flow path 42 may also be included. The air flow path 42 is connected in communication with the point of dispension 16, and is a means for providing a flow of air, such as a heated air stream. A valve 44 (e.g., a check valve) may be included in-line with the air flow path 42 to prevent backflow.

In operation, such as during a pre-wash or rinse sequence, liquid is communicated from the liquid source 26 to the dispension point 16 by opening and closing valve 48. During a product dispensing sequence, product is dispensed from product source 30 to dispension point 16 by operation of pump 36. Depending upon the type of product being dispensed, liquid from the liquid source 26 may be combined with product from the product source 30 by closing valve 48 and opening valve 38. The liquid may be used to control one or more attributes of the product being dispensed. For example, flow through the mixing flow path 54 may be used to control dilution and/or volumetric expansion of product communicated to the point of dispension 16 from the product source 30. The regulator 50 may be used to control the pressure of the product and liquid being dispensed during certain dispensing sequences. For example, during a soaping sequence, the pressure of the liquid may be decreased from the pressure of the source 26 to provide a low pressure dispension of soap product with liquid to achieve optimal wetting and lathering during the soaping and lathering sequences. A thermostatic mixing valve (not shown) may be used to control the temperature of liquid from the source 26 during one or more of the dispensing sequences. Following a rinse or post-washing sequence, the air source 46 may be used to pass a flow of air through the air flow path 42 to the point of dispension for drying the user's hands. As previously indicated, the flow of air may be dispensed at the point of dispension or another separate point of dispension on the body of the faucet. The dispensing system 10 may also be configured so that an air flow dispensing sequence follows dispensing of a hand freshener, a hand sanitizer or a hand conditioner. A mixing valve (not shown) may also be included at the dispension point to further control the ratio of liquid to product being dispensed. The mixing valve may also be used to control attributes of the dispension, such as for example the volumetric expansion of product alone or in combination with liquid being dispensed.

FIG. 8 illustrates another exemplary dispensing system of the present invention. The dispensing system illustrated in FIG. 8 includes a liquid source 26 connected in fluid communication with a dispension point 16. A valve 48, such as a solenoid valve, is included in line with the liquid flow path 24 between these two points. A foam flow path 29 is also connected in fluid communication with the dispension point 16 and can include a product line 28 and an air line 42, which may include a foaming chamber 31. The product line 28 extends between a product source 30, product pump 36 and the foaming chamber 31. The air line 42 extends from an air pump 46 to the foaming chamber 31. The product and air are mixed together to either create foam, or to have the air move the product through the line and towards the dispension point. The foaming chamber 31 may be located in the faucet, such as at the dispension point 16, or can be positioned away from the dispension point 16. In addition, the liquid source 26, product source 30, product pump 36 and air pump 46 may be contained in a dispenser module 27, which is located remote of the dispension point 16.

In operation, such as during a pre-wash or rinse sequence, liquid is communicated from the liquid source 26 to the dispension point 16 by opening and closing valve 48. During a product dispensing sequence, product is dispensed from product source 30 to the foaming chamber 31, while air is pumped from the air pump 46 to the foaming chamber 31. There, the air and product can be mixed to create foam. In other embodiments, the air can be used to dispense an amount of product at the dissension point 16. The rinse or post-washing sequence, as previously discussed, can then be operated.

FIG. 9 illustrates another exemplary dispensing system of the present invention. The dispensing system illustrated in FIG. 9 includes a liquid source 26 connected in fluid communication with a dispension point 16. A valve 48, such as a solenoid valve, is included in line with the liquid flow path 24 between these two points. A product flow path 28 is also connected in fluid communication with a mixing valve 52 and product source 30. A first pump 36, such as those previously described, is connected in operable communication with the product source 30 for pumping product through the product flow path 28 to the mixing valve.

An air flow path 42 is also included. The air flow path 42 is connected in communication with the mixing valve 52, and includes a second pump, preferably an air pump 46 which may be controlled independently from the first pump 36. In addition, a foamer 31 may be fluidly connected between the mixing valve 52 and the dispension point 16 via the foam flow path 29. The liquid source 26, product source 30, product pump 36, air pump 46, and mixing valve 52 may be contained in a dispenser module 27, which is located remote of the dispension point 16. The mixing valve 52 and foamer 31 can be positioned either within the dispenser module 27, or in the faucet such as at the dispension point 16.

As noted previously, the first pump 36 is independent from the second pump 46. This independence allows for the second pump 46 to be activated at different times and for different durations. This can create different flow rates and tactile profiles depending on user preference and product selection. These changes to flow rates and durations can typically be made by the software controlling the dispensing cycle, a manual valve to adjust air, a mixing chamber component, such as mixing chamber 52 or by adapting different sizes or styles of second pumps.

In operation, such as during a pre-wash or rinse sequence, liquid is communicated from the liquid source 26 to the dispension point 16 by opening and closing valve 48. During a product dispensing sequence, product is dispensed from product source 30 to the mixing valve 52, while air is pumped from the air pump 46 to the mixing valve 52. The air and product can be continued to the foamer 31, where the air and product are mixed to create a foam product. The foam product is then moved towards the dispension point 16. The rinse or post-washing sequence, as previously discussed, can then be operated.

Figure 3A:
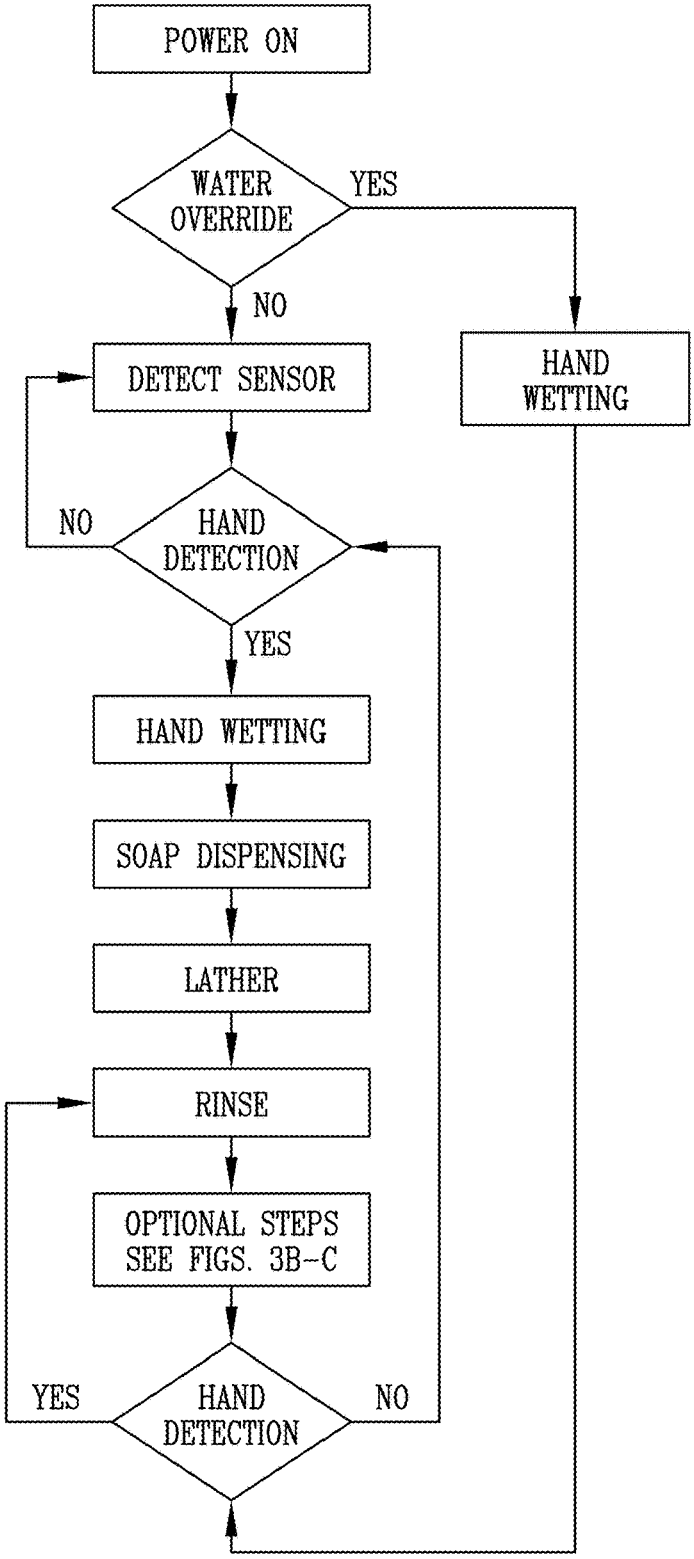
FIGS. 3A-C are diagrams of exemplary dispensing sequences according to one or more embodiments of the present invention.
Figure 3B:
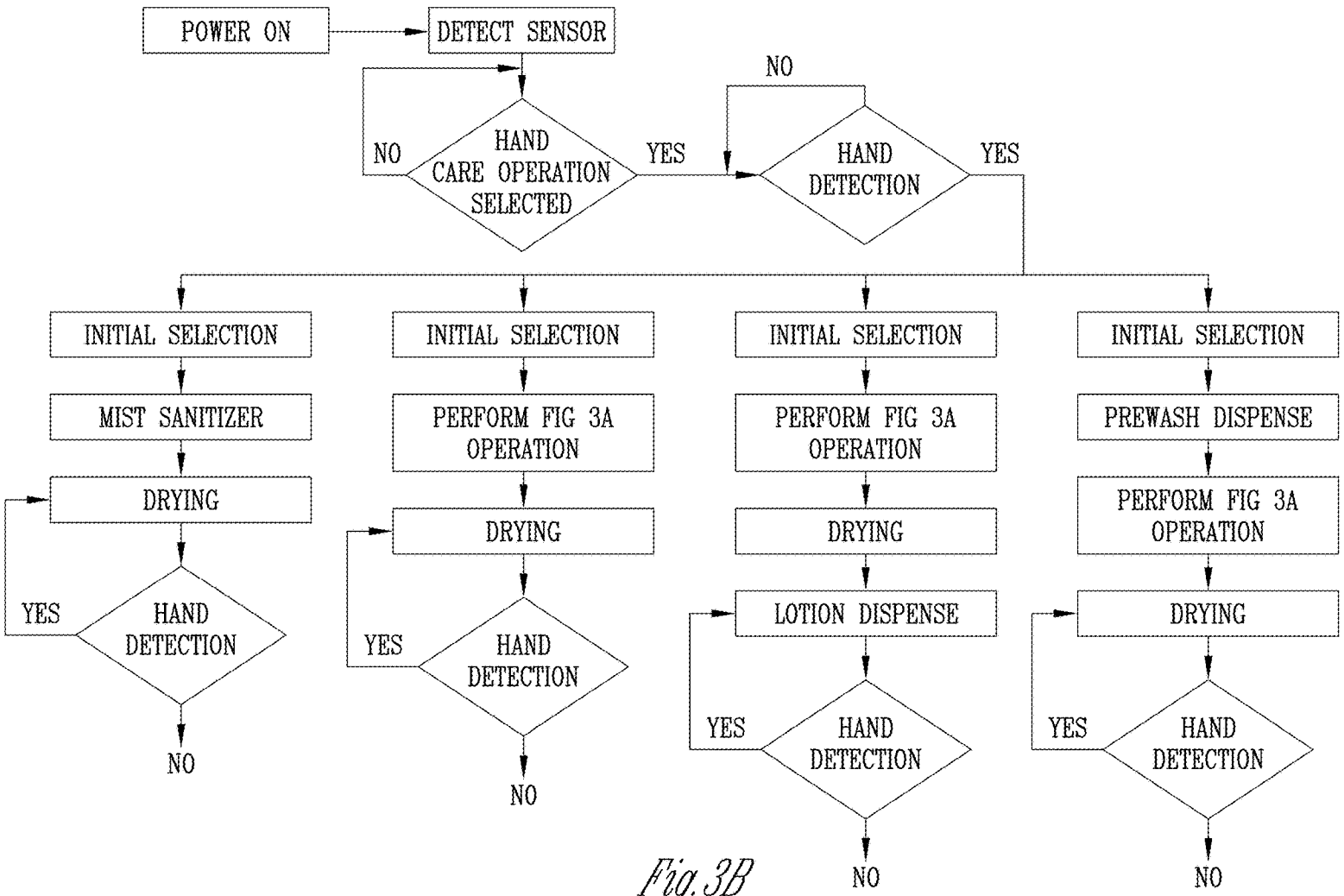
Figure 3C:
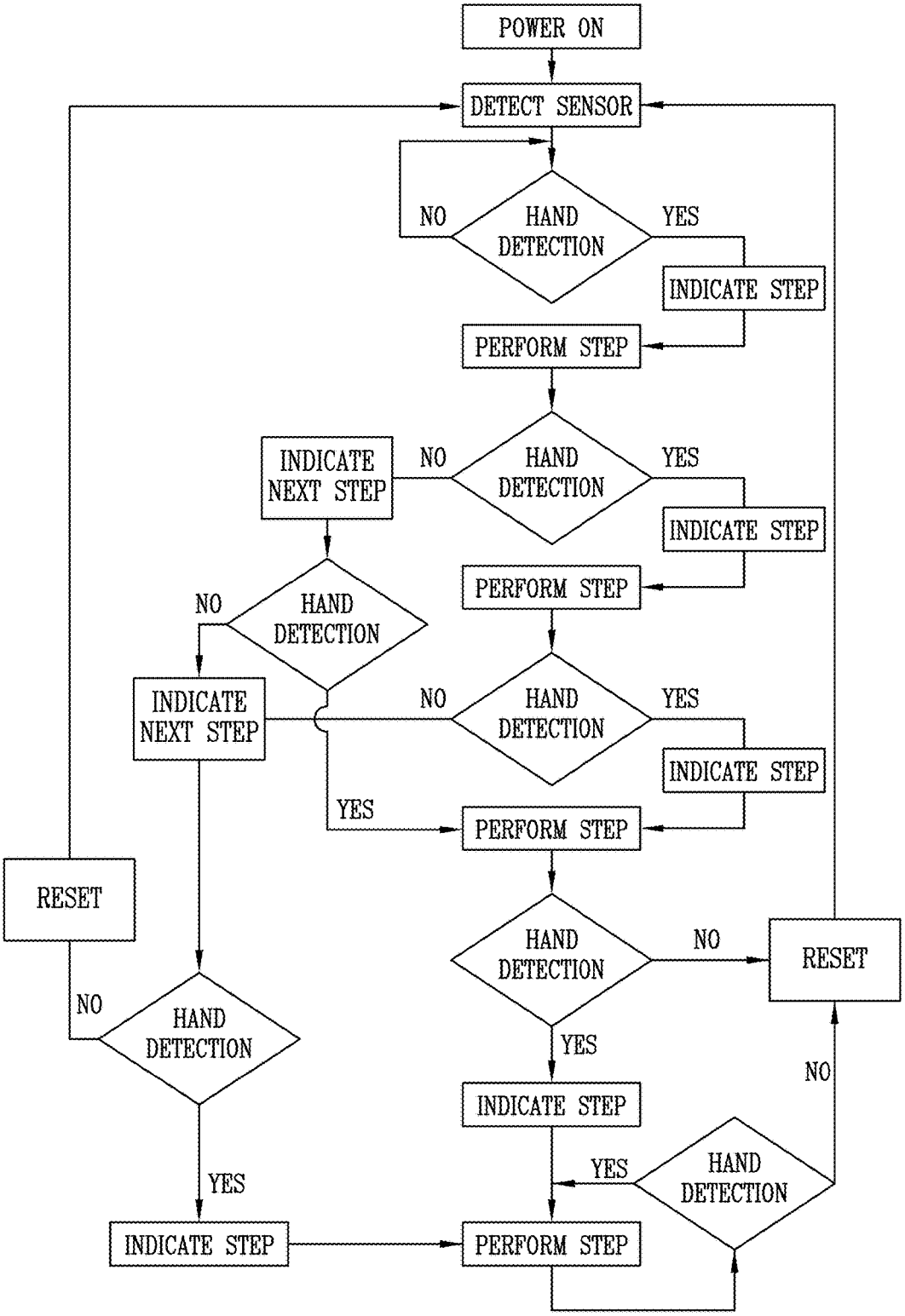
Figure 4:
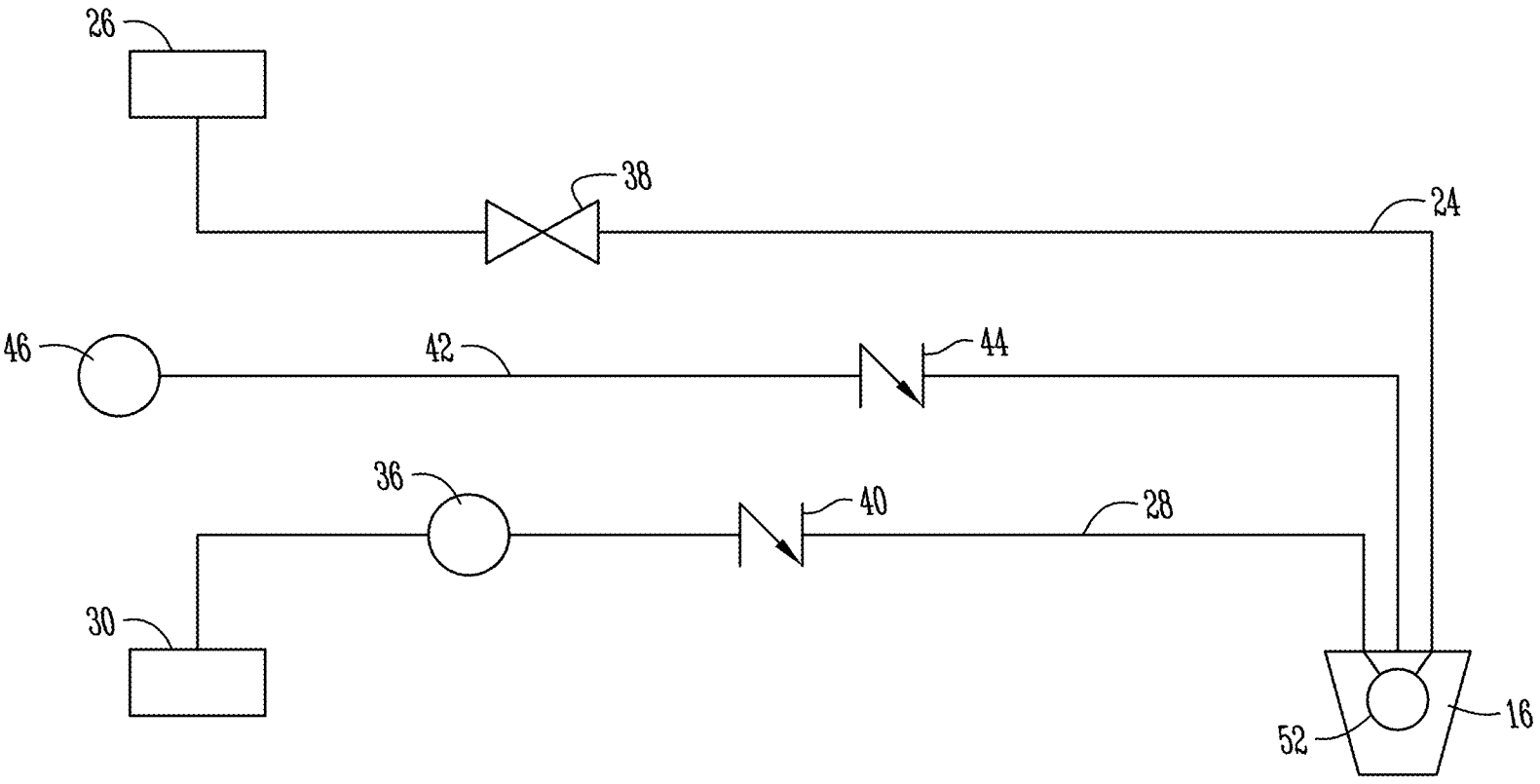
FIG. 4 is an exemplary plumbing diagram for an embodiment of the present invention.

FIGS. 3A-3C provide illustrations for exemplary dispensing sequences for the dispensing system 10. For example, FIG. 3A illustrates the dispensing sequences involved in a hand washing or hand care operation according to an exemplary aspect of the present invention. Once the system 10 is powered on, the sensor 20 is detected and the dispensing sequence is enabled. A user interface 18 (see FIG. 7) may be used to indicate to the user the type of sequence that is enabled. For example, the user interface 18 may be used to provide visual, audible, and/or tactile notifications for the various sequences involved in a hand care or washing process. This could include indicating to the user via visual notification, audible notification, and/or tactile notification that the dispenser is ready to dispense a pre-wash, a soap, a pre-rinse, a rinse, air, a sanitizer, a conditioner, a freshener, or any like hand care or washing sequence.

As previously discussed, the user may choose to operate the system 10 as a water only dispenser by pressing the water override button 23. Once pressed, the water override button 23 will send a signal to the controller 32, which will tell the valve 38, through means such as a solenoid valve, to open to allow liquid to pass through the liquid flow path 24 from the liquid source 26 and towards the dispension point 16. The amount of water dispensed can be controlled by the user directly as previously discussed or by the controller 32 by dispensing water for a predetermined amount of time, dispensing a predetermined amount of water, or, as shown in FIG. 3A, dispensing water until the user's hands are no longer detected by the sensor 20.

If the water override button 23 is not pressed and the sensor 20 detects a user's hands at the user reception point 22 for a defined duration (e.g., 1-2 seconds), the system 10 begins dispensing liquid at the point of dispension 16 for performing the various dispensing sequences. For example, as illustrated in FIG. 3A, the user interface 18 may be configured to indicate to the user when each of the dispensing sequences is occurring as shown in FIG. 7. This may include an indication when hand wetting is occurring, when soap dispensing is occurring, when lathering time is provided, and when the rinse sequence is occurring. In one embodiment of the invention, after the rinse sequence, the system checks for hand detection. If hand detection is positive, the system cycles the rinse sequence one more time. This could be repeated by the user as long as his or her hands are at the reception point and detected by the sensor 20. As previously indicated, optional steps may be included in the hand wash or hand care operation. FIGS. 3B-3C illustrate various hand washing and hand care operations that may be included as one or more sequences to the process. These sequences may be included in the hand washing or hand care operation according to the sequences shown in FIG. 3A or in other sequences as are contemplated by the present invention. For example, after the rinse sequence other sequences, such as a freshener dispensing sequence, a hand conditioning dispensing sequence and/or a sanitizing dispensing sequence may be run as part of a hand washing or hand care operation.

FIG. 3B illustrates several examples of various dispensing sequences contemplated by the present invention. Similar to the dispensing sequences illustrated in FIG. 3A, and upon powering on of the dispensing system 10, the sensor is detected and the system 10 awaits instruction and/or input from a user. Next, a user selects the hand care operation desired. This may include one or more hand care or hand washing sequences available in a menu provided on the user interface 18. These may be selected by tactile input commands and/or audible voice commands. Upon selection of the hand care operation, the sensor waits to begin the first dispensing sequence upon hand detection at the user reception point 22. The system may be configured to require hand detection for a certain period of time (e.g., 1-2 seconds) before initiating the hand care operation selection. For example, the system may be configured to wait before initiating the hand care operation to prevent accidental or unintended initiation of a hand care dispensing operation or sequence. Additionally, after each step, the dispensing system 10 may be configured to detect hands of a user at the user reception point 22 before proceeding to the next step to prevent waste and unintended or unwanted operation of the system.

According to one exemplary hand care operation shown in FIG. 3B, and upon selection from a user and detection of a user's hands at the user reception point 22, the selection is initiated. This may include misting a hand sanitizer from the dispension point 16 onto the user's hands. The sanitizer may also be dispensed as a stream. The attributes of the dispension of sanitizer may be controlled to create the best possible experience for the user. This may include volumetric expansion of the dispension, heating or cooling of the dispension, reducing or increasing the pressure of the dispension, or controlling other attributes. The user interface 18 may also be used to notify the user of these preferential attributes of the dispension (see FIG. 7). For example, the user interface may inform the user of the product being dispensed and the attributes of dispension.

Following misting of the sanitizer, the next sequence may be a drying sequence to aid in the drying of the user's hands. The drying sequence may be reinitiated after completion of the first drying sequence upon detection of the user's hands. Other hand care or hand washing operations are also shown in FIG. 3B. These are exemplary hand washing sequences and are only shown to provide an understanding of the breadth and scope of the various types of hand washing and hand care dispensing sequences that could make up a hand washing or hand care operation. For example, the operation illustrated in FIG. 3A could include a drying sequence as shown in FIG. 3B. It could also include a lotion dispensing sequence or a pre-wash dispensing sequence provided prior to the hand washing operation shown in FIG. 3A.

The use of the second pump 46 independent from the first pump 36 also allows for the product to be cleared from the system 10. This minimizes product contact with components that would otherwise be in constant contact with liquid and/or product solution. It also minimizes the risk of product remaining and creating clogs in the flow path. By clearing the product from the system 10, clogging chances are minimized to enhance the user experience and functionality of the device. Additionally, by clearing the product from the system 10, wear on components can be minimized to increase the lifespan of the system and/or reduce system component costs. Such clearing also allows new foam to be generated with every dispense cycle.

The timing of the dispensing sequences may be controlled so as to be optimal for allowing the user to receive and work the product into his or her hands, to allow adequate rinsing, or to allow the product to dry sufficiently. The sequences may also be controlled so as to allow a sufficient pause time between dispensing sequences such as for example to allow the user to work the soap or a pre-rinse into a lather before rinsing. Certain sequences may be reinitiated after completion of the first cycle of the sequence by detection of the hands at the user reception point 22. For example, upon completing a drying sequence and still detecting the hands of the user at the user reception point 22, the system 10 may be configured to reinitiate the drying sequence to provide further drying of the user's hands. This could also be applied to dispension of product where the user desires more than the quantity dispensed in the first initial dispension. For example, in a hand conditioner or sanitizer dispensing sequence the user may desire more. In this case, the user leaves his or her hands in the user reception point 22, which is detected by the sensor 20 for reinitiating the sequence to provide a second dispension of the product.

FIG. 3C illustrates other hand washing or hand care operations according to an exemplary embodiment of the present invention. In the exemplary dispensing sequences illustrates in FIG. 3C, the user is notified of the dispensing sequence beforehand, and upon placement of his or her hands into the user reception point 22, receives the product or the dispension for that particular dispensing sequence in a hands-free manner. Similar to previous versions, the dispensing system is powered on and the sensor 20 is detected. The system detects for a user's hands at the user reception point 22 and then indicates to the user via the user interface 18 the dispensing sequence that is to occur (see FIG. 7). The notification provided to the user may be an audible and/or tactile notification to or separate from a visual notification provided at the user interface 18.

As indicated, once hands of the user are detected, the system performs the indicated step. Steps within a hand washing or hand care operation may be skipped to move to a next step provided by the user interface 18. For example, if the system does not detect the user's hands, the system indicates the next step. If the step is the dispensing sequence that the user desires, the user places his hands into the user reception point 22, at which point the step being displayed is performed. In this manner, the user is notified of each subsequent step and may skip to the next step by allowing a certain period of time to pass (e.g., 2-3 seconds) before the dispensing system 10 iterates to the next dispensing sequence. If a dispensing sequence is desired, the user places his or her hands at the user reception point 22 at which point the step is performed. Thus, there may be steps in a hand washing or hand care operation that are offered but a user does not want. The unwanted dispensing or hand care sequence may be skipped by keeping the hands out of the user reception point 22 for a specific period of time until the user interface indicates to the user that the dispensing system has iterated to the next dispensing or hand care sequence.

Once the dispensing system has iterated through each one of the sequences, it resets the hand care or hand washing operation back to the beginning. In this manner, the user is not required to touch or handle the dispensing system other than place his or her hands at the user reception point 22 to indicate to the dispensing system 10 that the dispensing sequence being indicated is desired. The desired sequence is subsequently received by placement of his or her hands into the user reception point 22.

In another exemplary aspect of the present invention, the dispensing system 10 is configured to facilitate compliance with hand washing standards by dispensing appropriate amounts of product (e.g., soap, sanitizer), providing adequate time for scrubbing and lathering, and performing compliant prewash and/or rinse sequences. Since the various operating sequences are preferably timed, the dispensing system also provides metrics for use of the system, determining compliance with hand washing standards, and monitoring the various dispensing sequences and product. This data could be acquired and stored using the controller 32 in combination with a data store (not shown). The stored information could be acquired and processed to determine, for example, what sequences are being used the most, what sequences are being repeated, what sequences in a hand washing or hand care operation are not being performed to determine compliance, etc.

The above specification, examples, and information provide a description of the manufacture and use of the various embodiments of the present invention. Since many embodiments of the invention can be made without departing from the spirit and scope of the invention, the invention resides in the claims hereinafter appended.

What is claimed is:

1. A faucet adapted to provide one or more hand care alternatives, comprising:

a. a liquid flow path having:
  i. an inlet in fluid communication with a liquid source; and
  ii. an outlet in fluid communication with a dispension point; and b. a product flow path having:
  i. an inlet in communication with one or more hand care alternatives storage compartments;
  ii. an outlet in communication with the dispension point;
  iii. a first pump in communication with the one or more hand care alternatives storage compartments;

c. an air flow path having:
  i. a second pump independent from the first pump, the second pump in communication with an air source;

d. a mixing chamber having:
  i. a product inlet in fluid communication with the product flow path;
  ii. an air inlet in fluid communication with the air flow path; and a water override button in controlling communication with the liquid flow path, said water override button being operable independent of a sensor used to determine a user for using the faucet and wherein the sensor and water override button being positioned adjacent one another on a body of the faucet wherein detection of a user by the sensor will activate the faucet;

wherein said water override button is a button dedicated for bypassing a product dispense cycle of a dispensing sequence; wherein said sensor detects the user and operates the dispensing sequence comprising a rinsing liquid and soap, while the water override button is able to stop dispensing of the soap to provide the rinsing liquid; and wherein the mixing chamber is configured to combine a product from the one or more hand care alternatives storage compartments with air from the air flow path.

2. The faucet of claim 1 wherein the foamer is within the mixing chamber.

3. The faucet of claim 1 further comprising a foamer in the product flow path.

4. The faucet of claim 3 wherein the foamer is downstream from the mixing chamber.

5. The faucet of claim 1 wherein the liquid source, one or more hand care alternatives storage compartments, first pump, and second pump are contained in a dispenser module that is located remote from the dispension point.

6. The faucet of claim 5 wherein the foamer is located in the dispenser module.

7. A faucet adapted to provide one or more hand care alternatives, comprising:

a. a liquid flow path having:
  i. an inlet in fluid communication with a liquid source; and
  ii. an outlet in fluid communication with a dispension point; and b. a product flow path having:
  i. an inlet in communication with one or more hand care alternatives storage compartments;
  ii. an outlet in communication with the dispension point;

iii. a first pump in communication with the one or more hand care alternatives storage compartments;

c. an air flow path having:

i. a second pump independent from the first pump, the second pump in communication with an air source;

d. a mixing chamber having:

i. a product inlet in fluid communication with the product flow path;

ii. an air inlet in fluid communication with the air flow path;

a water override button in controlling communication with the liquid flow path, said water override button being operable independent of a sensor used to determine a user for using the faucet and wherein the sensor and water override button being positioned adjacent one another on a body of the faucet wherein detection of a user by the sensor will activate the faucet;

wherein said water override button is a button and dedicated for bypassing a product dispense cycle; wherein said sensor detects the user and operates a dispensing sequence comprising a rinsing liquid and soap, while the water override button is able to stop dispensing of the soap to provide the rinsing liquid; and said liquid source, one or more hand care alternative storage compartments, first pump, and second pump contained in a dispenser module positioned remote of the outlet; and wherein the mixing chamber is configured to combine a product from the one or more hand care alternatives storage compartments with air from the air flow path.

8. The faucet of claim 7 wherein the mixing chamber is in downstream communication with the first pump and the second pump, the mixing chamber further including a foaming medium.

9. The faucet of claim 7 further comprising a valve in communication with the first pump.

10. The faucet of claim 7 further comprising a valve in communication with the second pump.

11. The faucet of claim 7 further comprising a foaming medium in communication with the product flow path.

* * * * *